United States Patent [19]

Chidsey

[11] 4,011,799

[45] Mar. 15, 1977

[54] CARTON ERECTING APPARATUS

[75] Inventor: Francis A. Chidsey, Devon, Pa.

[73] Assignee: Container Corporation of America, Chicago, Ill.

[22] Filed: Nov. 10, 1975

[21] Appl. No.: 630,142

[52] U.S. Cl. ..... 93/53 SD; 93/84 FF

[51] Int. Cl.[2] ..... B31B 1/80

[58] Field of Search ..... 93/53 SD, 53 R, 53 M, 93/84 FF, 49 R, 36 R; 53/385, 384

[56] References Cited

UNITED STATES PATENTS

| | | | |
|---|---|---|---|
| 2,541,607 | 2/1951 | Piazze | 93/53 R |
| 3,682,052 | 8/1972 | Vuilleumier et al. | 93/53 R |
| 3,728,945 | 4/1973 | Vuilleumier | 93/53 R |
| 3,896,711 | 7/1975 | Vuilleumier | 93/53 SD |

*Primary Examiner*—James F. Coan
*Attorney, Agent, or Firm*—Carpenter & Ostis

[57] ABSTRACT

Apparatus for erecting flattened tubular cartons held in a hopper and depositing them on an endless conveyor which includes structure mounted for reciprocal movement between the hopper and conveyor and having vacuum transfer means for gripping a carton and plenum means at one end of the carton for opening the carton.

6 Claims, 4 Drawing Figures

CARTON ERECTING APPARATUS

SUMMARY OF THE INVENTION

The invention relates to apparatus for erecting folding cartons by the application of a positive air pressure against at least one of the ends of the carton in a manner somewhat similar to that disclosed in U.S. Pat. Nos. 3,728,945 and 3,896,711.

In the invention of U.S. Pat. No. 3,728,945 air pressure is used to erect a tubular carton after it has been deposited on an endless conveyor.

In the invention of U.S. Pat. No. 3,896,711 air pressure is used to erect the carton before it is placed on a conveyor.

It is an object of the present invention, however, to utilize air pressure to open or erect a tubular carton while it is being transferred from a hopper to a conveyor.

A more specific object of the invention is the provision, in apparatus of the type described, of structure mounted for reciprocal movement between a hopper containing cartons in a flattened condition and an endless conveyor, which includes vacuum transfer means for gripping and moving a carton, and plenum means for applying a blast of air to at least one end of the carton while it is being moved by the vacuum transfer means.

These and other objects of the invention will be apparent from an examination of the following description and drawings.

THE DRAWINGS

Figure 1:
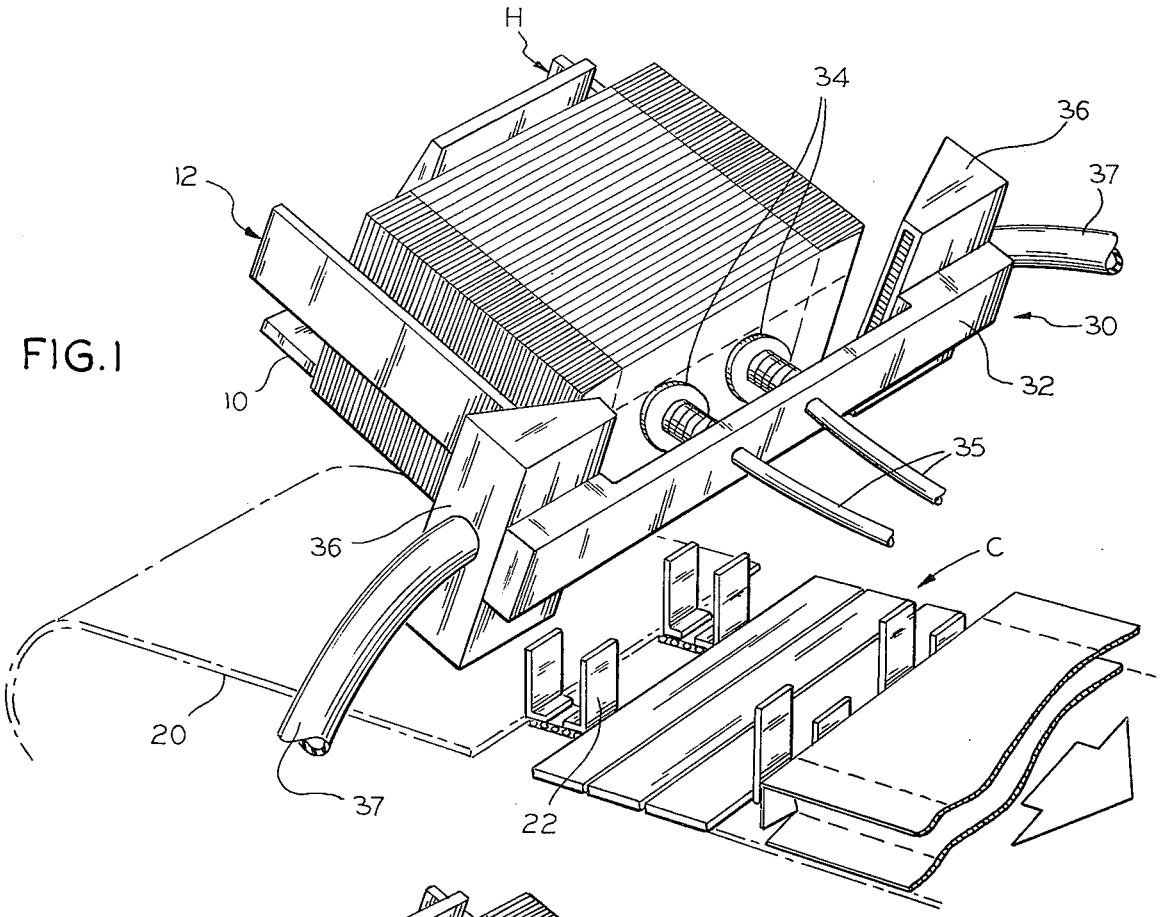
Figure 2:
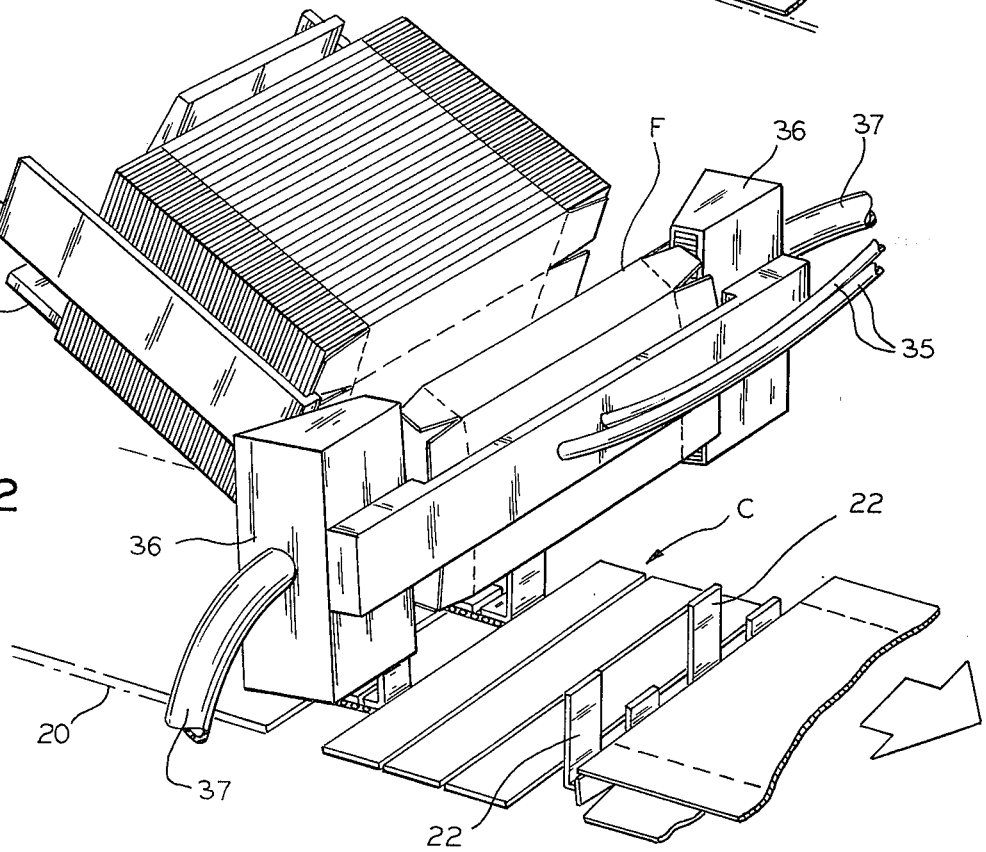
Figure 3:
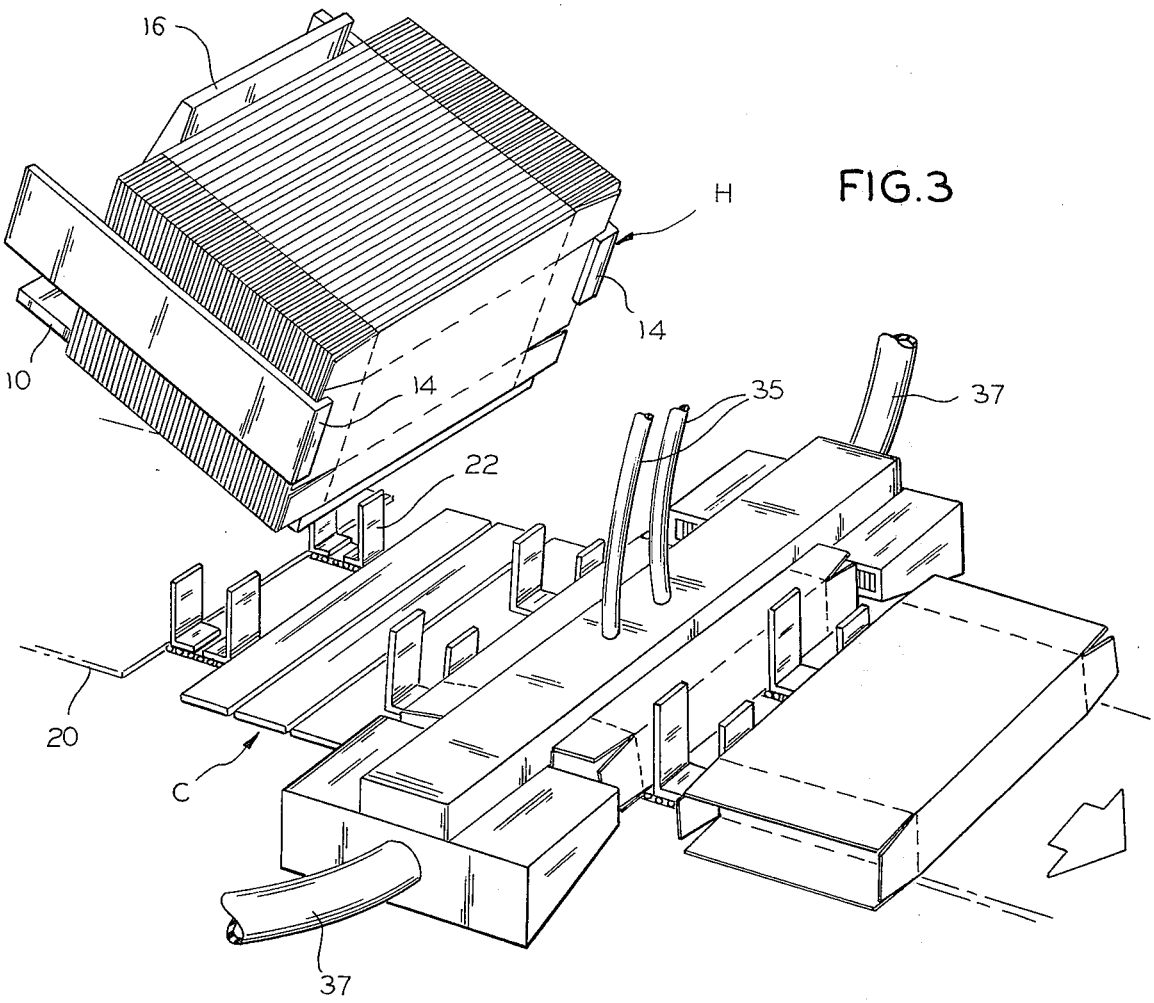
Figure 4:
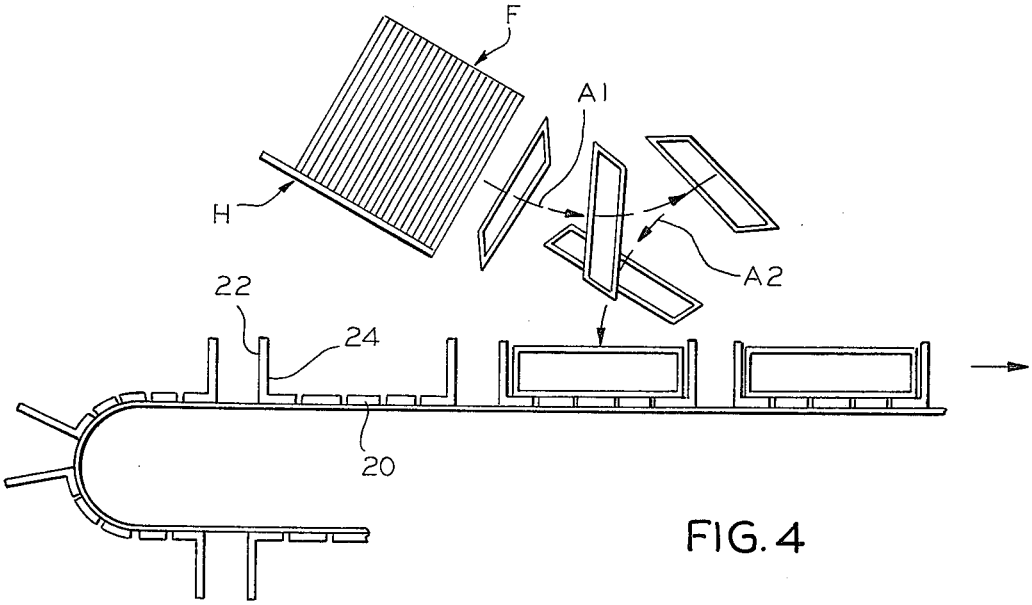

FIGS. 1, 2 and 3 are fragmentary perspective views of a carton erecting apparatus embodying features of the invention shown in the various positions it assumes during the erection of a carton; and FIG. 4 is a diagrammatic sketch illustrating the movement of a carton as it is being erected by the apparatus of the previous views.

It will be understood that, for purposes of clarity, certain elements may have intentionally been omitted from certain views where they are believed to be illustrated to better advantage in other views.

THE SPECIFICATION

Referring now to the drawing for a better understanding of the invention, it will be seen that there is illustrated in FIGS. 1, 2 and 3, apparatus embodying features of the invention which is used to erect folding cartons from a flattened condition.

Only the essential features of the apparatus are illustrated and the specific structural details of the mechanism are not shown because they may be of a conventional nature of the type commonly found on hoppers, conveyors and other portions of conventional carton erecting apparatus.

It will be seen that a plurality of collapsible tubular paperboard folding cartons indicated generally at F are stacked in a flattened condition on a hopper mechanism indicated generally at H. The hopper includes a shelf or base 10 for supporting the cartons, and a pair of spaced arms 12 which engage the opposite ends of the carton to maintain them in alignment on base 10. At their forward extremes the arms 12 may be provided with relatively narrow inwardly extending flanges 14 which retain the cartons in the hopper until they are pulled away one by one by the carton transfer mechanism in a manner hereinafter described. Additionally, the hopper may include at its rearward or upper end a pusher plate 16 which serves to push the cartons forwardly and downwardly against the flanges 14 of the hopper arms 12.

The hopper H is positioned over a conveyor mechanism indicated generally at C which includes an endless belt or chain 20 having a plurality of flights or lugs 22 which project upwardly from belt 20 and defined therebetween spaces or pockets 24 each having the same dimension as the width of the carton when the carton is in erected condition.

The essential feature of the invention resides in the provision of a novel carton erecting and transfer mechanism indicated generally at 30 which is mounted over conveyor C for reciprocal movement between hopper H and conveyor C. The structural details of the carton erecting and transfer mechanism are not all shown, however, the essential portion of the structure is illustrated. This structure includes a laterally extending frame 32 which carries one or more vacuum cups 34 which are connected to a vacuum source not shown through one or more hoses 35 which may be disposed to extend through frame 32.

Mounted at at least one end of the frame and preferably at both ends of the frame are a pair of generally funnel shaped air plenum members 36 which may be connected to a source of positive air pressure by means of hoses 37.

Turning now to FIG. 4 it will be seen that the reciprocal movement of the carton erecting and transfer mechanism 30 during each cycle of the carton transfer and erecting operation includes a movement through a pair of arcs. The first movement is upwardly and to the right as shown in FIG. 4, and then downwardly and to the left as shown in FIG. 4.

To describe the operation of the device, as the frame moves toward the upper exposed panel, the bottom carton in the stack is gripped by the vacuum cups 34 and as the frame moves away from the hopper, the bottom carton is pulled away from the stack of cartons in the hopper and past the flanges 14 of the hopper arms. At this point the frame begins to move in an upward arc indicated at A1 in FIG. 4, and, as this is happening, a positive air pressure in the form of a blast of air is introduced into the ends of the carton from the plenums 36, causing the tubular carton to begin to open. When the frame reaches the upward limit of its movement in arc A1, it begins to move in a downward arc, indicated by A2 in FIG. 4, and the air pressure from the plenums continues to be introduced into the ends of the carton until the carton is fully opened or in a fully erected condition as the frame reaches the lowermost point of arc A2. At this point the vacuum pressure is terminated and the carton is permitted to drop into the appropriate pocket or space 24 between a series of flights 22 on the conveyor belt 20 which is continuously moving away from the hopper in the direction illustrated in FIG. 4.

At this point the movement of the frame is reversed and it moves upwardly through arc A2 and then back to the rear through arc A1 as the vacuum pressure is again actuated and the vacuum cups engage the next carton for a repetition of the process. Inasmuch as the positive air pressure is functioning to open the cartons while they are being transferred from the hopper to the conveyor, it will be understood that the carton erection and transfer mechanism operates in a highly efficient manner so as to maximize the speed with which cartons can be drawn from the hopper, erected and deposited in an erected condition on the conveyor.

I claim:

1. In an apparatus for erecting collapsible, open-ended, tubular cartons each comprising a plurality of foldably interconnected panels, the combination of:

a. a hopper member for holding a plurality of cartons in flattened condition;

b. a conveyor member positioned adjacent said hopper member and including retaining means, which are spaced from each other a distance equal to the width of an erected carton, for retaining erected cartons therebetween;

c. carton erecting and transfer structure mounted for reciprocal movement between said hopper member and said conveyor member;

d. said structure including:

i. vacuum transfer means for engaging a panel of one of said cartons in said hopper member;

ii. moveable plenum means adjacent at least one end of said structure for applying positive air pressure against at least one end of said one carton to erect said carton as said carton is transferred by said structure from said hopper member to said conveyor member;

e. means for moving said structure between said hopper member and said conveyor member whereby said plenum means moves in unison with said vacuum transfer means.

2. An apparatus according to claim 1, wherein said means for moving said structure moves said structure through at least one arc as said structure travels between said hopper and conveyor members.

3. An apparatus, according to claim 1, wherein said carton erecting structure includes a laterally extending bar, and wherein said vacuum transfer means includes at least one vacuum cup mechanism mounted on said bar for movement therewith.

4. In an apparatus for erecting collapsible, open-ended, tubular cartons each comprising a plurality of foldably interconnected panels, the combination of:

a. a hopper member for folding a plurality of cartons in flattened condition;

b. a conveyor member positioned adjacent said hopper member and including retaining means, which are spaced from each other a distance equal to the width of an erected carton, for retaining erected cartons therebetween;

c. carton erecting and transfer structure mounted for reciprocal movement between said hopper member and said conveyor member;

d. said structure including:

i. vacuum transfer means for engaging a panel of one of said cartons in said hopper member;

ii. plenum means adjacent at least one of said structure for applying positive air pressure against at least one end of said one carton to erect said carton as said carton is transferred by said structure from said hopper member to said conveyor member;

e. means for moving said structure between said hopper member and said conveyor member whereby said structure moves through a pair of separate arcs.

5. In an apparatus for erecting collapsible, open-ended, tubular cartons each comprising a plurality of foldably interconnected panels, the combination of:

a. a hopper member for holding a plurality of cartons in flattened condition;

b. conveyor member positioned adjacent said hopper member and including retaining means, which are spaced from each other a distance equal to the width of an erected carton, for retaining erected cartons therebetween;

c. carton erecting and transfer structure mounted for reciprocal movement between said hopper member and said conveyor member;

d. said structure including:

i. a laterally extending bar;

ii. vacuum transfer means for engaging a panel of one of said cartons in said hopper member;

iii. at least one plenum mounted adjacent an end of said bar for movement therewith and for applying positive air pressure against at least one end of said one carton to erect said carton as said carton is transferred by said structure from said hopper member to said conveyor member;

e. means for moving said structure between said hopper member and said conveyor member.

6. In an apparatus for erecting collapsible, open-ended, tubular cartons each comprising a plurality of foldably interconnected panels, the combination of:

a. a hopper member for holding a plurality of cartons in flattened condition;

b. a conveyor member positioned adjacent said hopper member and including retaining means, which are spaced from each other a distance equal to the width of an erected carton, for retaining erected cartons therebetween;

c. carton erecting and transfer structure mounted for reciprocal movement between said hopper member and said conveyor member;

d. said structure including:

i. a laterally extending bar;

ii. vacuum transfer means including at least one vacuum cup mechanism mounted on said bar for movement therewith;

iii. a pair of plenums mounted on opposite ends of said bar for movement therewith and for applying positive air pressure against at least one end of said one carton to erect said carton as said carton is transferred by said structure from said hopper member to said conveyor member.

e. means for moving said structure between said hopper member and said conveyor member.

* * * * *